US005396784A

United States Patent [19]

Huenniger

[11] Patent Number: 5,396,784

[45] Date of Patent: Mar. 14, 1995

[54] OIL MANAGEMENT SYSTEM FOR SCREW COMPRESSOR UTILIZED IN REFRIGERATION SYSTEM

[75] Inventor: Edward A. Huenniger, Liverpool, N.Y.

[73] Assignee: Carrier Corporation, Syracuse, N.Y.

[21] Appl. No.: 223,973

[22] Filed: Apr. 6, 1994

[51] Int. Cl.[6] ..... F25B 43/02

[52] U.S. Cl. ..... 62/471; 62/84

[58] Field of Search ..... 62/470, 471, 194, 84

[56] References Cited

U.S. PATENT DOCUMENTS 1,965,544 7/1934 Fedders ..... 62/194

1,987,591 1/1935 Askin ..... 62/194

5,086,621 2/1992 Starner et al. .

*Primary Examiner*—John M. Sollecito

[57] ABSTRACT

An oil management system for a refrigeration system having a screw compressor for pressurizing and circulating refrigerant through the system and an evaporator having a shell enclosing a chamber for allowing phase change of the refrigerant. A suction line is provided to fluidly connect the evaporator chamber to the inlet side of the compressor. The suction line is sealed about an opening in the shell and has a distal end projecting into the chamber below the seal. A reservoir is positioned within the chamber, below the suction line. The reservoir is employed for collecting lubrication oil migrating down the suction line during low load operation of the compressor so that when the level of oil in the reservoir reaches a predetermined level, the opening in the distal end of the line will be restricted thereby increasing the flow velocity proximate thereto causing reintroduction of the oil into the compressor.

6 Claims, 2 Drawing Sheets

OIL MANAGEMENT SYSTEM FOR SCREW COMPRESSOR UTILIZED IN REFRIGERATION SYSTEM

BACKGROUND OF THE INVENTION

1. Field of the Invention

This invention relates in general to refrigeration systems and, in particular, to the screw compressor employed in such systems. More specifically, but without restriction to the particular embodiments hereinafter described in accordance with the best mode of practice, this invention relates to an oil management system for the inlet pipe of a screw compressor employed in a chiller type refrigeration system.

2. Discussion of the Related Art

Screw compressors are commonly employed in a number of applications from providing pressurized air for pneumatic tools to circulating a refrigerant through the refrigeration cycle in a cooling system. One particular use of the screw compressor is in a refrigeration system commonly known as a chiller. In addition to the screw compressor, the typical chiller also includes a condenser, an evaporator or cooler, an oil-refrigerant separator, a refrigerant storage tank, and a throttling valve. These components are connected to each other by tubing that carries the refrigerant through the system. The evaporator typically includes a plurality of tubes that circulate water in a closed loop to another heat exchanger or cooling coil. At the cooling coil, circulating room air is induced through the cooling coil by a fan so that heat is removed from the circulating room air.

The components of the chiller are customarily arranged relative to one another such that the suction inlet pipe of the screw compressor is directed downwardly into the evaporator. The screw compressor is lubricated in part by oil draining from the compressor bearings being entrained into the suction gas entering the rotors. The combined oil and refrigerant mixture is carried through the compression cycle and then discharged into the system separator where the oil is removed from the refrigerant. During low load operation of the chiller, there is insufficient gas velocity to effectively entrain this oil into the gas flow entering the compressor. At this level of operation, it is common for lubricating oil to continuously flow down the suction inlet and into the evaporator where it has the undesirable effect of mixing with the refrigerant. In this manner, oil is lost from the compressor resulting in an insufficiently lubricated compressor and a reduction in chiller performance caused by the presence of large quantities of oil in the refrigerant circuit.

There has been proposed various solutions attempting to solve the problem of this type of oil loss in a screw compressor operating at reduced loads. These solutions include simply preventing the compressor from operating at loads low enough to cause this type of oil loss, installing baffle arrangements designed to catch the oil and return it to the compressor by use of an ejector system, and employing a distillation process to remove the excess oil from the refrigeration circuit. The first solution is inappropriate in many applications requiring low load operation of the screw compressor. The last two proposed typify solutions that involve extensive design modifications which add a significant cost to manufacturing the refrigeration system.

OBJECTS AND SUMMARY OF THE INVENTION

It is, therefore, an object of the present invention to improve refrigeration systems.

Another object of this invention is to improve the operation of screw compressors utilized in refrigeration systems.

It is a further object of the present invention to prevent oil loss in a screw compressor operating at low loads in a refrigeration system.

Still another object of the present invention is to prevent screw compressor oil from flowing into the evaporator of a refrigeration system employing the compressor in a chiller.

It is yet a further object of the present invention to avoid extensive design modifications in a chiller employing a screw compressor while adapting the chiller to operate at low loads without oil loss.

Yet another object of the present invention is to increase the flow velocity of refrigerant entering the suction inlet pipe of the screw compressor of a refrigeration system when the compressor is operating at low loads.

An additional object of the present invention is to prevent oil from entering the refrigerant circuit of a chiller utilizing a screw compressor.

Yet a further object of the present invention is to maintain chiller performance by preventing compressor lubricating oil from mixing with refrigerant in the evaporator and the refrigerant circuit of the chiller.

These and other objects are attained in accordance with the present invention wherein there is provided an oil management system for a refrigeration system having a screw compressor for pressurizing and circulating refrigerant through the system and an evaporator having a shell enclosing a chamber for allowing phase change of the refrigerant. In accordance with one aspect of the invention, a suction line fluidly connects the evaporator chamber to the inlet side of the compressor. The suction line is sealed about an opening in the shell and has a distal end projecting into the chamber below the seal. According to another aspect of this invention, a reservoir is positioned within the chamber, below the suction line. The reservoir is employed for collecting lubrication oil migrating down the suction line during low load operation of the compressor so that when the level of oil in the reservoir reaches a predetermined level, the opening in the distal end of the line is restricted thereby increasing the flow velocity proximate thereto causing reintroduction of the oil into the compressor.

BRIEF DESCRIPTION OF THE DRAWING

Further objects of the present invention together with additional features contributing thereto and advantages accruing therefrom will be apparent from the following description of a preferred embodiment of the invention which is shown in the accompanying drawing, wherein.

DETAILED DESCRIPTION OF A PREFERRED EMBODIMENT

Figure 1:
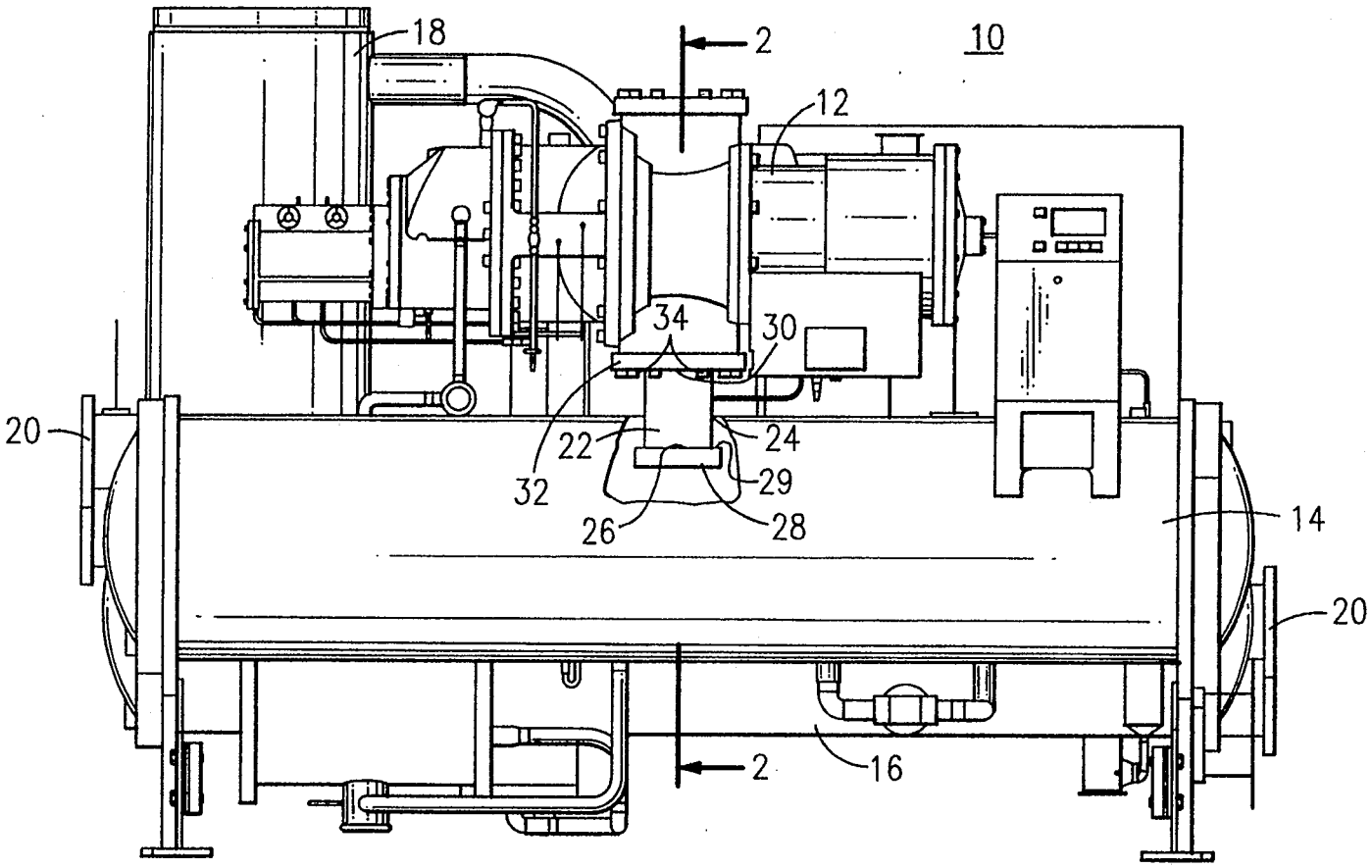
FIG. 1 is a front elevation view of a chiller employing a screw compressor in accordance with the present invention, the evaporator thereof being broken away to reveal the present improvement.

Referring now to the drawing and initially to FIG. 1 there is shown a chiller 10 in accordance with the present invention. The chiller 10 includes a screw compressor 12, an evaporator or cooler 14, a condenser 16, and an oil-refrigerant separator 18. The chiller 10 also includes a pair of flange connectors 20—20 which would be connected to suitable piping to circulate the chilled water from the chiller 10 to a remotely situated heat exchanger. The screw compressor 12 includes a suction inlet pipe 22 which extends into the evaporator 14 through an opening 24 provided in the evaporator. The inlet pipe 22 terminates within the evaporator at a distal end 26 thereof. A cap-shaped oil reservoir 28 is secured to the distal end 26 of the inlet pipe 22 with passageway or gap 29 provided therebetween to allow proper refrigerant flow through the inlet pipe 22. The inlet pipe 22 also includes a proximal end 30 which is welded to a mounting plate 32 which in turn is bolted to the screw compressor 12 by mounting bolts 34.

Figure 2:
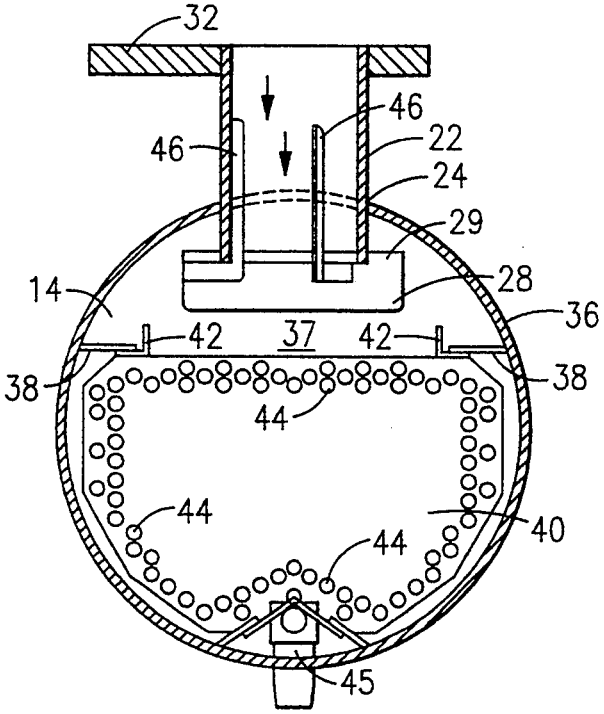
FIG. 2 is a cross sectional view of the present invention taken along section line 2—2 of FIG. 1, FIG. 2 showing in detail the oil reservoir according to this invention.

Referring now to FIG. 2 wherein it is shown that the evaporator 14 includes an evaporator shell 36 which has a pair of horizontal mounting flanges 38—38 welded on the interior side of the shell 36 as shown. The evaporator shell 36 encloses an interior chamber 37 within the shell which is sealed to the external environment. A tube carriage 40 is provided within the internal chamber 37 and is suspended therein by a pair of elongated angle brackets 42—42 which are mounted to the tube carriage 40 and the mounting flanges 38—38. The tube carriage 40 carries a plurality of water tubes 44 horizontally through the evaporator. During operation of the chiller 10, relatively cool liquid refrigerant from the condenser 16 is directed into the evaporator 14 through an inlet pipe 45. The liquid exiting the condenser 16 is relatively warm. It cools down as a result of passing through a valve before entering the evaporator 14. The pressure drop across this valve causes some of the condensed liquid refrigerant to change to a gaseous phase, which in turn, cools down the rest of the liquid. The liquid refrigerant then comes in contact with the water tubes 44 which are carrying warm water. The heat from the warm water passing through the water tubes 44 is absorbed into the liquid refrigerant which then vaporizes or evaporates while increasing in temperature. The refrigerant which is now in a vapor state, is induced by suction into the compressor 12 through the suction inlet 22 thereof. In the compressor 12, the vaporized refrigerant is then increased in pressure and temperature as a result of the compression experienced therein. The compressor then discharges the refrigerant into the condenser 16. The condenser 16 also includes a shell enclosing water tubes. The water flowing through the condenser tubes absorbs heat from the compressed refrigerant which causes the refrigerant to condense. This condenser water is then sent to a cooling tower to reject the absorbed heat to outside air.

In order for the screw compressor 12 to function properly, oil must drain from the compressors bearings into the refrigerant gas entering the rotors of the screw compressor 12. The oil mixed with refrigerant is then carried through the compression cycle within the screw compressor 12. Before the heated and pressurized oil-refrigerant mixture can be introduced into the condenser 16, it is passed through the separator 18, shown in FIG. 1, where the oil is removed and returned to the compressor 12. The refrigerant, less any oil, is then moved from the separator 18 into the condenser 16 and the refrigeration cycle is repeated.

Figure 3:
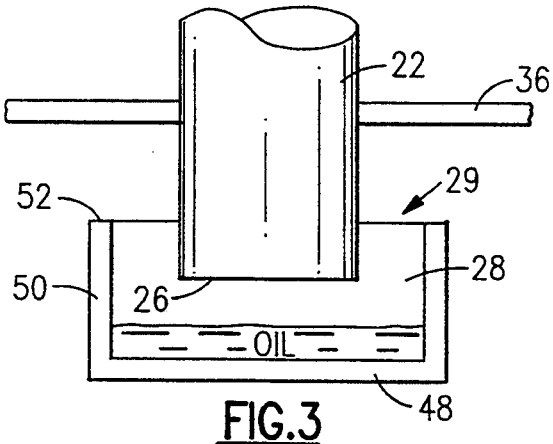
FIG. 3 is a schematic representation of the present invention illustrating operation of the oil reservoir.
Figure 4:
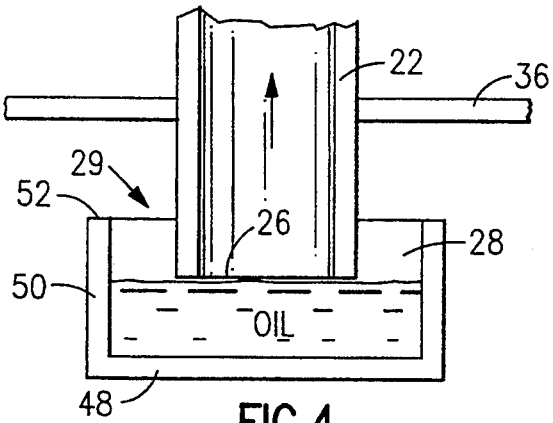
FIG. 4 is a view similar to FIG. 3 showing the present oil reservoir filled to capacity.

During high load operation of the chiller 10, sufficient gas velocity is maintained within the suction inlet pipe 22 to prevent any compressor oil from sliding down the suction inlet 22 into the evaporator. However, during low load operation of the chiller 10, lubricating oil from the screw compressor 12 will migrate down the inlet pipe 22 and begin to collect in the oil reservoir 28 as represented in FIG. 3. The oil reservoir 28 is mounted proximate the distal end 26 of the section inlet pipe 22 by L-shaped mounting brackets 46 as shown in FIG. 2. As shown in FIGS. 3 and 4, the oil reservoir 28 includes a bottom plate portion 48 and an upperwardly directed side rim 50 which terminates at a top edge 52. The L-shaped mounting brackets 46 are employed to position the top edge 52 of the side rim 50 above the opening in the distal end 26 of the section inlet pipe 22 as shown in FIGS. 2, 3 and 4. As represented in FIG. 3, during very low loads of operation of the chiller 10, the reservoir 28 will capture the lubricating oil flowing down the suction pipe 22. The oil level within the reservoir 28 will increase until it approaches the distal end 26 of the inlet pipe 22 as represented in FIG. 4. When the oil reaches this level, a liquid seal will form between the oil and the section inlet pipe 22. Continued compressor operation will then create a relative vacuum in the suction pipe 22. The volume of gas in the suction pipe 22 is small relative to the suction capacity of the compressor 12 even at low load operation. This relative vacuum is thus created very quickly and results in the captured oil in the reservoir being rapidly reingested into the screw compressor 12.

In accordance with the best mode for practicing the present invention, the sizing of the reservoir 28 and its geometric relationship to the suction pipe 22 is determined for each particular chiller 10 so that when the screw compressor 12 is operating at full load, the oil reservoir 28 does not restrict the refrigerant flow or increase gas velocity so as to cause an increased pressure drop which would reduce chiller performance. The volummetric capacity of the reservoir is thus kept to a minimum so as to reduce the possibility of undue restriction of the inlet pipe 22 when the chiller is operated at high capacity loads. At the same time, the reservoir 28 must be sized large enough to collect a predetermined amount of oil which will fall back through the section pipe 22 during low load operation and allow for expansion of the oil due to absorbsion of gas refrigerant which may result if the chiller is shut down at a point in time when the reservoir is nearly full of oil. The optimum capacity of the reservoir is further determined so that the volume of oil contained therein is relatively small to the total refrigerant charge of the chiller so that any spill over will not result in a measurable system performance degradation.

There has thus been shown a simple yet effective oil management system for a chiller employing a screw compressor. The disclosed oil management system is economical, effective and does not require substantial modifications to the components used in the chiller.

While this invention has been described in detail with reference to a certain preferred embodiment, it should be appreciated that the present invention is not limited to that precise embodiment. Rather, in view of the present disclosure which describes the best mode for practicing the invention, many modifications and variations would present themselves to those of skill in the art without departing from the scope and spirit of this invention, as defined in the following claims.

What is claimed is:

1. In a refrigeration system of the type having a screw compressor with an inlet for pressurizing and circulating refrigerant through the system and an evaporator having a shell enclosing a chamber for allowing phase change of the refrigerant, the improvement comprising:

a suction line fluidly connecting the evaporator chamber to the inlet of the compressor, said suction line being sealed about an opening in the shell and having an open distal end projecting into the chamber below the seal; and said suction line and said screw compressor positioned with respect to said evaporator and a reservoir means positioned within the chamber and below said suction line, thereby defining means for collecting lubrication oil migrating down said suction line during low load operation of the compressor so that when the level of oil in said reservoir means reaches a predetermined level, the opening in the distal end of the line will be restricted thereby increasing the flow velocity proximate thereto causing reintroduction of the oil into the compressor.

2. The refrigeration system according to claim 1 wherein said reservoir means includes a cap-shaped member having a bottom surface and an upwardly directed side rim with a top edge.

3. The refrigeration system according to claim 2 including mounting brackets for positioning said cap-shaped member around said suction line so that the top edge of the cap member is situated above the said distal end of said suction line with a fluid passageway retained between the cap member and said suction line.

4. The refrigeration system according to claim 3 wherein said fluid passageway has a predetermined flow capacity allowing heavy load operation of the system without increasing the gas velocity entering said suction to thereby avoid an increase in pressure drop and resultant reduction in chiller performance.

5. The refrigeration system according to claim 1 wherein said reservoir means has a capacity for containing a predetermined volume of oil accounting for expansion of the oil due to absorbsion of gas refrigerant.

6. The refrigeration system according to claim 5 wherein said predetermined volume of oil contained within said reservoir means is small relative to the total refrigerant charge of the system so that any oil spillover from said reservoir means will have a negligible effect on overall system performance.

* * * * *